United States Patent [19]

Bixler

[11] Patent Number: 5,061,208

[45] Date of Patent: Oct. 29, 1991

[54] CONDUCTIVE SHELL FOR CLAMPING ONTO A SHIELDED ELECTRICAL CONNECTOR

[75] Inventor: Craig A. Bixler, Elmhurst, Ill.

[73] Assignee: Molex Incorporated, Lisle, Ill.

[21] Appl. No.: 573,508

[22] Filed: Aug. 27, 1990

[51] Int. Cl.[5] ..... H01R 13/648; H01R 4/18

[52] U.S. Cl. ..... 439/610; 439/730; 439/906

[58] Field of Search ..... 439/607, 609, 610, 904, 439/905, 906, 730

[56] References Cited

U.S. PATENT DOCUMENTS

| | | | |
|---|---|---|---|
| 2,526,277 | 10/1950 | Rogoff | 439/730 X |
| 4,457,576 | 7/1984 | Cosmos et al. | 439/610 |
| 4,615,578 | 10/1986 | Stadler et al. | 439/607 |
| 4,678,256 | 7/1987 | Nishino et al. | 439/607 X |
| 4,838,808 | 6/1989 | Fujiura | 439/610 X |
| 4,921,441 | 5/1990 | Sauder | 439/610 X |

*Primary Examiner*—Larry I. Schwartz
*Assistant Examiner*—Julie R. Daulton
*Attorney, Agent, or Firm*—Louis A. Hecht; Stephen Z. Weiss; A. A. Tirva

[57] ABSTRACT

An electrical connector assembly includes a two piece die-casted conductive shell that is adapted to be clamped onto a shielded electrical connector. The electrical connector may be formed of a dielectric housing with four sidewalls extending between a mating end and a wire receiving end. A plurality of contacts disposed in the housing are adapted to be connected to conductors extending into the wire receiving end of the electrical connector. A stamped and formed conductive shield surrounds at least a portion of the housing sidewalls. The two piece die-casted or molded plastic shell is formed by the mating of two shell portions with a set of screws projecting through one of the shell portions into the other of the shell portions. When so mated, the shell engages the connector shield to thereby couple the shell to the connector shield and a pocket is formed adjacent the wire receiving end of the electrical connector for enclosing splices between the shielded conductors in a cable and the conductors extending out from the wire receiving end of the electrical connector. In addition, the rear end of the mated shell portions form a wire clamping section for coupling the shell to a braided shield of the cable and for providing a strain relief for the cable. The wire clamping section may be disposed so that the cable is held at a desired angle with respect to the electrical connector housing.

15 Claims, 2 Drawing Sheets

CONDUCTIVE SHELL FOR CLAMPING ONTO A SHIELDED ELECTRICAL CONNECTOR

BACKGROUND OF INVENTION

1. Field of the Invention

The present invention relates to a conductive shell for a shielded electrical connector, and more particularly, to a metal shell that is adapted to be clamped onto a shielded electrical connector so as to provide the shielded electrical connector with a special cable termination.

2. Description of the Prior Art

Electrical connectors are mated together in a number of different applications in order to provide an electrical interface between conductors or circuits coupled to the electrical connectors. In certain applications, an electrical connector is adapted to receive a plurality of individual wires that are coupled to electrical contacts within the electrical connector. One end of each of the electrical contacts is coupled to one of the conductors extending into the electrical connector with the other end of the contact being adapted to engage a contact in the electrical connector with which it is to be mated. While the electrical connector used with such individual conductors may have a number of different configurations, it typically includes a dielectric housing with four sidewalls extending between a front mating end and a rear wire receiving end. The plurality of conductors to be coupled to the contacts in the electrical connector can be inserted into the wire receiving end of the electrical connector and coupled to the individual ones of the electrical contacts. If the electrical connector is to be shielded, a conductive metal shield is mounted about the sidewalls of the dielectric housing of the electrical connector. The metal shield is used as an EMI/RFI shield to insure that noise signals or other interference that may be present near the electrical connectors do not interfere with the signals being processed through those connectors and that the signals being processed through those connectors do not interfere with electrical components near the connectors. Various different types of such shielded electrical connectors are disclosed in U.S. Pat. Nos. 4,337,989; 4,544,227; 4,639,067; 4,641,902; and 4,838,808 and in European Patent Application No. 0 073 957 A2.

In many instances, the metal shields are stamped and formed requiring relatively expensive tooling to manufacture the shield to a shape that is needed for it to properly fit about the dielectric housing of the electrical connector and to provide a termination for the conductors in a cable or the like. As a result different tooling is required for each different type of termination that is needed with respect to a particular electrical connector. For example, a different electrical shield would have to be provided depending on whether the conductors connected to the electrical connector are enclosed in a shielded cable or whether such a cable extends at right angle or in line with respect to the wire receiving end of the electrical connector. When the cable has a braided shield surrounding the conductors, special provisions must be made in order to interconnect the braided shield of the cable to the shield of the electrical connector. However, the stamping and forming of so many different shields may be prohibitively expense.

SUMMARY OF THE INVENTION

Accordingly, one object of the present invention is to provide a new and improved conductive shell that is adapted to be clamped onto an electrical connector having a shield surrounding at least a portion of the dielectric housing of the electrical connector.

It is another object of the present invention to provide a new and improved two piece conductive shell that is die-casted and is adapted to be clamped onto an electrical connector having a stamped and formed shield.

It is yet another object of the present invention to provide a new and improved electrical connector assembly having a conductive shell clamped onto a shielded portion of the electrical connector assembly such that the electrical connector assembly may be provided with special termination configurations for the conductors that are to be coupled to the electrical connector.

It is still another object of the present invention to provide a new and improved conductive shell that is adapted to be clamped onto a shielded electrical connector so as to form a shield about spliced electrical connections between conductors coupled to the electrical connector and a cable containing a plurality of conductors.

In accordance with these and many other objects, an embodiment of the present invention comprises an electrical connector assembly having a two piece die-casted conductive shell that is adapted to be clamped onto a shielded electrical connector. The electrical connector may be of various configurations but typically includes a dielectric housing formed with four sidewalls extending between a mating end and a wire receiving end. A plurality of contacts are disposed in the housing with a contact portion near the mating end and a wire receiving portion adapted to be connected to conductors extending into the wire receiving end of the electrical connector. A stamped and formed conductive shield surrounds at least a portion of the housing sidewalls so as to provide the electrical connector with a shield from electrical and magnetic interference. The conductors extending into the wire receiving end of the electrical connector may be spliced to conductors and shields in a cable with which the electrical connector is to be used.

In order to provide different configurations for the interconnection of the electrical connector to the conductors contained in the shielded cable, the two piece die-casted shell is clamped onto the electrical connector shield. The shell is formed by mating two pieces, a top portion and a bottom portion. The top and bottom portions are of the same general configuration so that they can be mated together by a set of screws projecting through the bottom portion into the top portion. When so mated, the shell engages the connector shield to thereby couple the shell to the connector shield and a pocket is formed adjacent the wire receiving end of the electrical connector for enclosing the splices between the shielded conductors in the cable and the conductors extending out from the wire receiving end of the electrical connector. In addition, the rear end of the mated shell sections form a wire clamping section for coupling the shell to a braided shield of the cable and for providing a strain relief for the cable.

Because the shell is die-casted in metal, molded from conductive plastic or molded from non conductive plastic and coated with a conductive material, it can be economically made in different configurations to provide the electrical connector with different cable terminations. For example, the cable clamping portion of the shell can be generally in alignment with the longitudinal axis of the shell when the cable is to be disposed generally in alignment with the longitudinal axis of the electrical connector extending between the front mating and wire receiving ends of the electrical connector. On the other hand, the cable clamping portion of the shell can extend at a generally right angle to the longitudinal axis of the shell when the cable is to be disposed at a right angle with respect to the longitudinal axis of the electrical connector.

BRIEF DESCRIPTION OF THE DRAWINGS

Many other objects and advantages of the present invention will become apparent upon consideration of the following detailed description in conjunction with the drawings in which.

DETAILED DESCRIPTION OF THE PREFERRED EMBODIMENT

Figure 1:
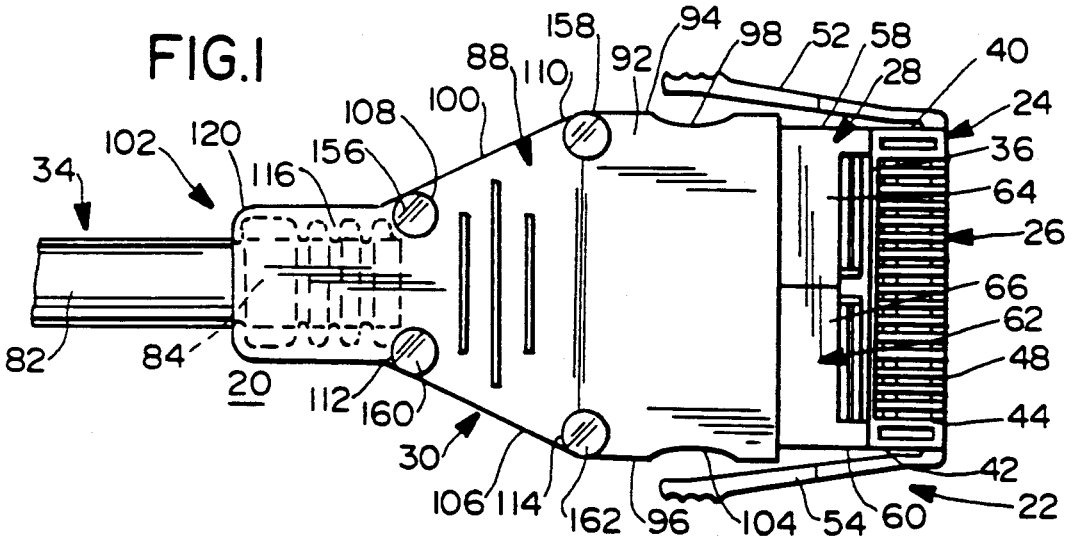
FIG. 1 is a bottom view of one embodiment of a shielded electrical connector assembly embodying the present invention including a conductive shell clamped onto a shielded electrical connector.
Figure 2:
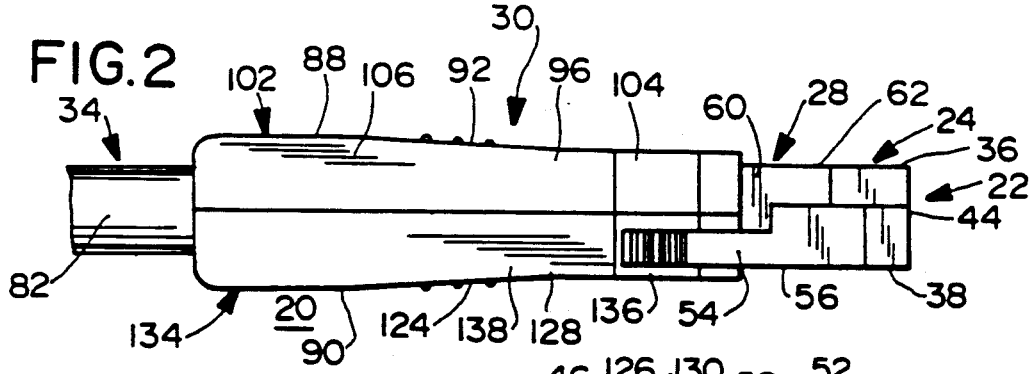
FIG. 2 is a side view of the electrical connector assembly disclosed in FIG. 1.
Figure 3:
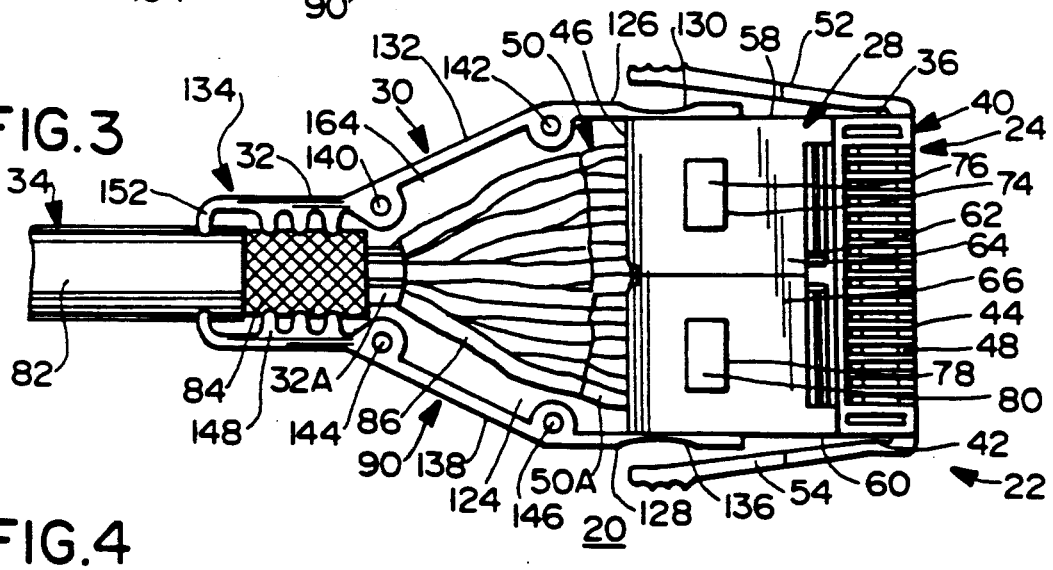
FIG. 3 is a bottom view of the electrical connector assembly disclosed in FIG. 1 with a bottom shell portion of the conductive shell removed so as to show how the conductors in a cable may be terminated to conductors extending from the wire receiving end of the electrical connector.

Referring now more specifically to FIGS. 1–3 of the drawings, therein is disclosed an electrical connector assembly which is generally designated by the numeral 20 and which embodies the present invention. The electrical connector assembly 20 disclosed in FIGS. 1–3 includes an electrical connector 22 having a dielectric housing 24. The electrical connector 22 is adapted to be inserted into a receptacle (not shown) such that electrical contacts 26 in the electrical connector 22 will be mated with contacts in such a receptacle. In order to provide the electrical connector 22 with a shield, a stamped shield 28 is secured about a portion of the dielectric housing 24. The electrical connector assembly 20 also includes a conductive shell 30 that is adapted to be clamped onto the shield 28. In the case of the embodiment disclosed in FIGS. 1–3, the shell 30 enables conductors 32 contained in a cable 34 to be coupled to the contacts 26 in the electrical connector 22 when the cable 34 extends towards the electrical connector 22 generally in a direction in alignment with the front to rear or longitudinal axis of the electrical connector 22.

The dielectric housing 24 of the electrical connector 22 includes a bottom wall 36, a top wall 38, and opposed sidewalls 40 and 42 that extend between a front or mating end 44 and a rear or wire receiving end 46. A series of longitudinally extending slots or opening 48 are provided at the front or mating end 44 of the bottom wall 36. One of the electrical contacts 26 is disposed in each of the slots 48 so that each of the electrical contacts 26 may be mated with a corresponding contact in the receptacle into which the electrical connector 22 is to be inserted. Each of the electrical contacts 26 is coupled to one of a plurality of conductors 50 that extend through the wire receiving end 46 into the interior of the dielectric housing 24.

In order to maintain the electrical connector 22 mated in the receptacle, cantilevered thumb actuated latch arms 52 and 54 are provided on the sidewalls 40 and 42, respectively. The latch arms 52 and 54 normally extend resiliently away from the sidewalls 40 and 42 so that they will become lodged in recesses in the receptacle when the electrical connector 22 is mated with such a receptacle.

The shield 28 is a stamped and formed metallic shield that may be formed into a generally planar strip and wrapped about the dielectric housing 24. When the shield 28 is positioned about the dielectric housing 24, the shield 28 includes a top wall 56 that covers a portion of the top wall 38 of the housing 24, sidewalls 58 and 60 that cover respectively portions of the sidewalls 40 and 42 of the housing 24, and a bottom wall 62 having sections 64 and 66. The bottom wall 36 of the dielectric housing 24 has a groove (not shown) extending from the wire receiving end 46 toward the mating end 44. Edges of the bottom wall sections 64 and 66 are lodged in the groove in order to secure the shield 28 about the housing 24. In order to further assist in properly positioning and retaining the shield 28 about the housing 24, the bottom wall section 64 of the shield 28 has an opening or window 74 through which a raised portion 76 ont he bottom wall 36 projects and the bottom wall section 66 of the shield 28 has an opening or window 78 through which a raised portion 80 on the bottom wall 36 projects. When the shield 28 is in place about the dielectric housing 24, a portion of the front mating end 44 containing the slots 48 is not covered by the shield 28 so that the electrical contacts 26 may be mated with contacts in the receptacle into which the electrical connector 22 is adapted to be inserted.

As previously indicated, each of the electrical contacts 26 is adapted to be coupled to one of the conductors 50 extending into the wire receiving end 46 of the electrical connector 22. When the electrical connector 22 is to be used with a cable 34 containing the plurality of conductors 32, each of the individual conductors 32 in the cable 34 needs to be coupled to two of the conductors 50. The manner in which the conductors 50 are coupled to the conductors 32 in the cable 34 is illustrated in FIG. 4 of the drawings.

Figure 4:
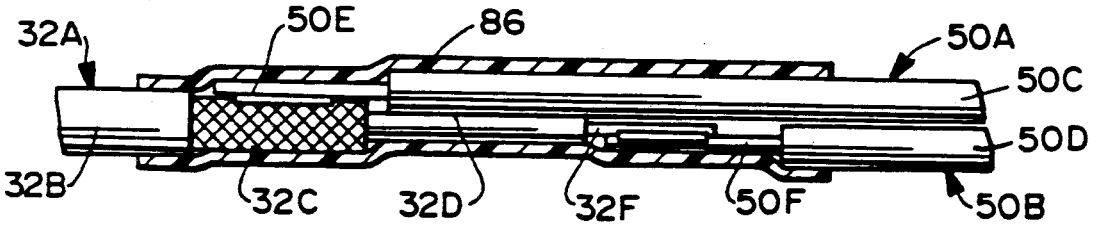
FIG. 4 is a side view, partially in cross-section, showing how individual cable conductors shown in FIG. 3 may be coupled to the conductors extending out from the wire receiving end of the electrical connector.

As can be seen in FIGS. 3–4, the cable 34 has an outer insulating jacket 82 covering concentrically a braided shield 84. The individual conductors 32 in the cable 34 are contained within the braided shield 84 which normally is grounded and thus provides a shield for the conductors 32. As illustrated in FIG. 4 in connection with a conductor 32A, each of the conductors 32 includes an outer insulating jacket 32B, a braided shield 32C, an inner insulating jacket 32D and a wire 32E. As also is illustrated in FIG. 4 in connection with conductors 50A and 50B, each of the conductors extending out from the wire receiving end 46 of the electrical connector 22 includes an outer insulating jacket 50C or 50D and a wire 50E or 50F.

In order to couple the conductor 32A to the conductors 50A and 50B, the conductor 32A is prepared by stripping portions of the outer insulation 32B, the braided shield 32C and the inner jacket 32D so that portions of the braided shield 32C, the inner jacket 32D and the wire 32E are exposed. In a similar fashion, portions of the outer insulations 50C and 50D are stripped from the conductors 50A and 50B in order to expose the wires 50E and 50F. The exposed wire 50E is placed adjacent the braided shield 32C and is coupled by soldering or the like to the braided shield 32C. Similarly, the exposed wire 50F is placed adjacent the exposed wire 32E and is coupled by soldering or the like to the exposed wire 32E. After the wire 32E is coupled to the wire 50F and the shield 32C is coupled to the wire 50E, a heat shrinkable tube 86 is slid over the spliced connections. Heat is applied to the tube 86 and it shrinks about those connections. Consequently, as is the case with respect to the conductor 32A, each of the conductors 32 in the cable 34 has its wire 32E coupled to a wire 50F in one of the conductors 50B extending into the wire receiving end 46 of the electrical connector 22 and its braided shield 32C coupled to a wire 50E in another of the conductors 50A.

In order to maintain the cable 34 adjacent to the rear wire receiving end 46 of the electrical connector 22 and also to provide a shield about the splices between the conductors 32 and the conductors 50, the electrical connector assembly 22 includes the clamp on shell 30. In the case of the electrical connector assembly 20 shown in FIGS. 1–3 of the drawings, the shell 30 is adapted to position the cable 34 with respect to the electrical connector 22 such that the cable 34 extends towards the electrical connector 22 generally parallel to the axis that extends between the front mating end 44 and the rear wire receiving end 46 of the electrical connector 22. The shell 30 includes two portions or sections, namely a lower or bottom shell portion 88 and an upper or top shell portion 90.

The bottom shell portion 88 has a bottom wall 92 from which extends sidewalls 94 and 96. The sidewall 94 has an indentation 98 and an angled or converging wall portion 100 that extends to a cable clamping rear portion 102 at the rear of the shell 30. Similarly, the sidewall 96 has an indentation 104 and an angled or converging wall portion 106 that converges toward the wall portion 100 as it extends to the cable clamping portion 102. Four screw holes 108, 110, 112 and 114 are located at the ends of the wall portions 100 and 106. As is seen in FIG. 1, the cable clamping portion 102 has semi-circular fingers 116 that are adapted to grip the braided cable shield 84 when the shell portions 88 and 90 are mated in order to couple the braided shield 84 to the bottom section 88 of the shell 30 and thereby to the shield 28 surrounding the dielectric housing 24. In addition, the cable clamping portion 102 includes a semi-circular finger 120 that grips the outer insulation 82 on the cable 34 when the shell portions 88 and 90 are mated to provide a portion of a cable strain relief for the cable 34.

The upper shell portion 90 is shaped similarly to the lower shell portion 88 such that the shell portions 88 and 90 may be mated together. The shell portion 90 includes a top wall 124 from which extends sidewalls 126 and 128. The sidewall 126 has an indentation 130 and an angled or converging wall portion 132 that extends to a cable clamping rear portion 134 at the rear of the shell 30. Similarly, the sidewall 128 has an indentation 136 and an angled or converging wall portion 138 that extends to the cable clamping portion 134. Four threaded screw receiving holes 140, 142, 144 and 146 are located at the ends of the wall portions 132 and 138. As is seen in FIG. 3, the cable clamping portion 134 has semi-circular fingers 148 that are adapted to grip the braided cable shield 84 when the shell portions 88 and 90 are secured together in order to couple the braided shield 84 to the shell 30 and thereby to the shield 28 surrounding the dielectric housing 24. In addition, the cable clamping portion 134 includes a semi-circular finger 152 that grips the outer insulation 82 on the cable 34 when the shell portions 88 and 90 are secured together to provide a portion of the cable strain relief for the cable 34.

The two portions 88 and 90 of the shell 30 are adapted to be mated together so as to form the shell 30 that clamps onto the electrical connector 22 as shown in FIGS. 1–3. The two portions 88 and 90 are held together with screws 156, 158, 160 and 162 that extend through the holes 108, 110, 112 and 114, respectively, in the bottom portion 88 and that become engaged in the threaded holes 140, 142, 144 and 146 in the top portion 90. With the bottom portion 88 and the top portion 90 so mated, the sidewalls 94 and 96 of the bottom portion 88 respectively are mated with the sidewalls 126 and 128 of the top portion. When clamped onto the electrical connector 22, the sidewalls 94 and 96 of the bottom shell portion 88 respectively engage the sidewalls 40 and 42 of the shield 28 adjacent the indentations 98 and 104. Similarly, the sidewalls 126 and 128 of the top shell portion 90 respectively engage the sidewalls 40 and 42 of the shield 28 adjacent the indentations 130 and 136. Consequently, the shell 30 is coupled to the shield 28 by means of this contact.

The shell portions 88 and 90 also form a pocket 164 between the converging wall portions 100, 106, 132 and 138 that are mated together. The pocket 164 provides an enclosed and shielded area from the disposition of the splices between the conductors 32 in the cable 34 and the conductors 50 extending out from the rear wire receiving end 46 of the electrical connector 22. The cable clamping portions 102 and 134 of the shell portions 88 and 90 are mated together and couple the shell 30 to the braided shield 84 of the cable 34. This is accomplished through the fingers 116 in the case of the bottom portion 88 and the fingers 148 in the case of the top portion 90 gripping the braided shield 84 when the shell portions 88 and 90 are secured together. Moreover, the cable clamping portions 102 and 134 through the finger 120 in the case of the bottom shell portion 88 and the finger 152 in the case of the top shell portion 90 provide a cable strain relief mechanism for the cable 34 once the shell portions 88 and 90 have been clamped onto the electrical connector 22.

With the shell 30 enclosing at least a portion of the electrical connector 22 and encompassing the connections between the conductors 32 in the cable 34 and the conductors 50 extending into the electrical connector 22 and with the shell 30 being connected to both the shield 28 and the grounded braided shield 84 of the cable 34, the shell 30 provides an EMI/RFI shield for a portion of the electrical connector 22 and the wire connections. However, the shell 30 does not enclose the portion of the shield 28 adjacent the front mating end 44 so that the shield 28 can be engaged by a shield on the receptacle with which the electrical connector 22 is to mate. Moreover, the shell 30, in clamping onto a standard shielded electrical connector, such as the electrical connector 22, can provide different terminations for the cable 34 as it extends to such an electrical connector 22 without requiring a special stamped and formed shield to be tooled for each different type of termination to be made between a cable, such as the cable 34, and the electrical connector 22.

As previously noted, the shell 30 terminates the cable 34 such that the cable 34 generally is disposed parallel to the axis of the electrical connector 22 extending between the front mating end 44 and the rear wire receiving end 46. In certain instances, the cable 34 needs to be disposed at a different angle to that axis. It is not economically practical to have a different stamped and formed shield for each different termination configuration that is required. Accordingly, the shell 30 is made by a die-cast process so that different configured terminations may be economically provided. For example, one alternate termination configuration is a right angle termination that is provided by an electrical connector assembly 200 that is disclosed is FIGS. 5–7.

Figure 7:
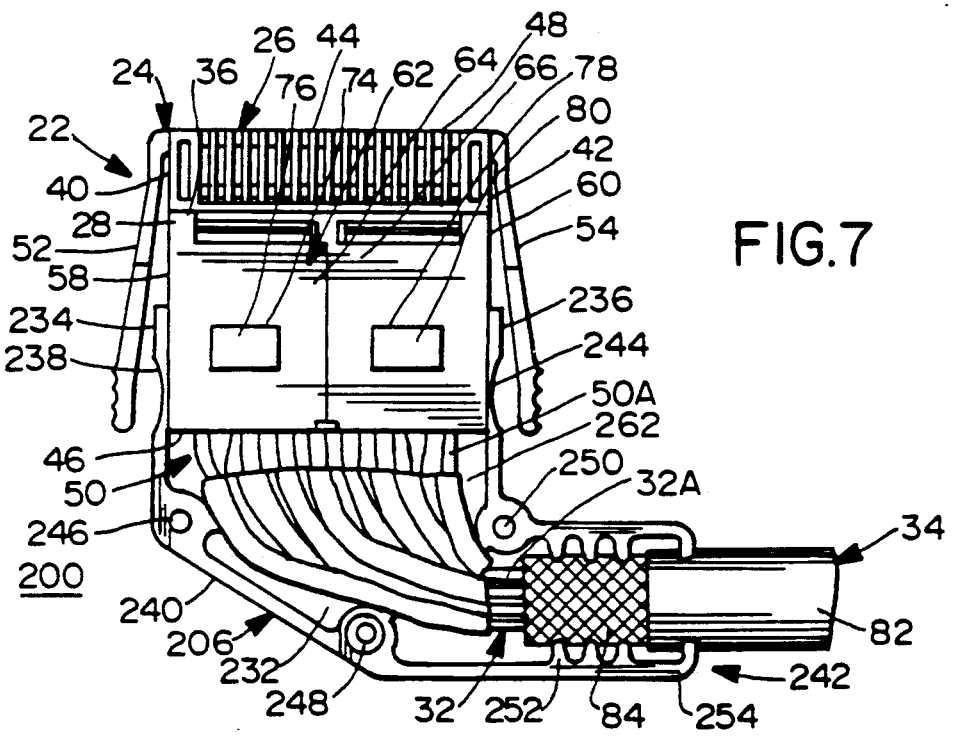
FIG. 7 is a bottom view of the electrical connector assembly disclosed in FIG. 5 with a bottom portion of the conductive shell removed so as to show how the conductors in a cable may be terminated to conductors extending from the wire receiving end of the electrical connector.
Figure 6:
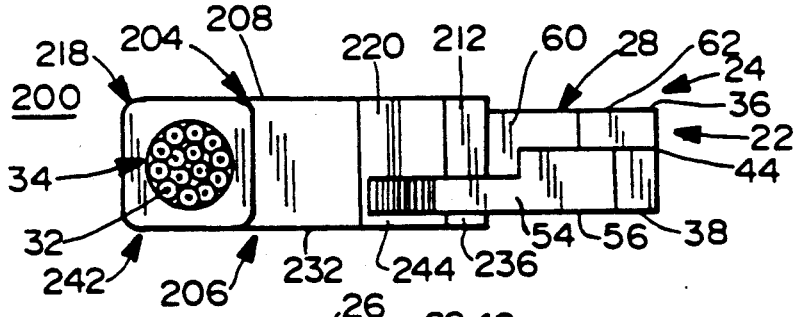
FIG. 6 is a side view of the electrical connector assembly disclosed in FIG. 5.
Figure 5:
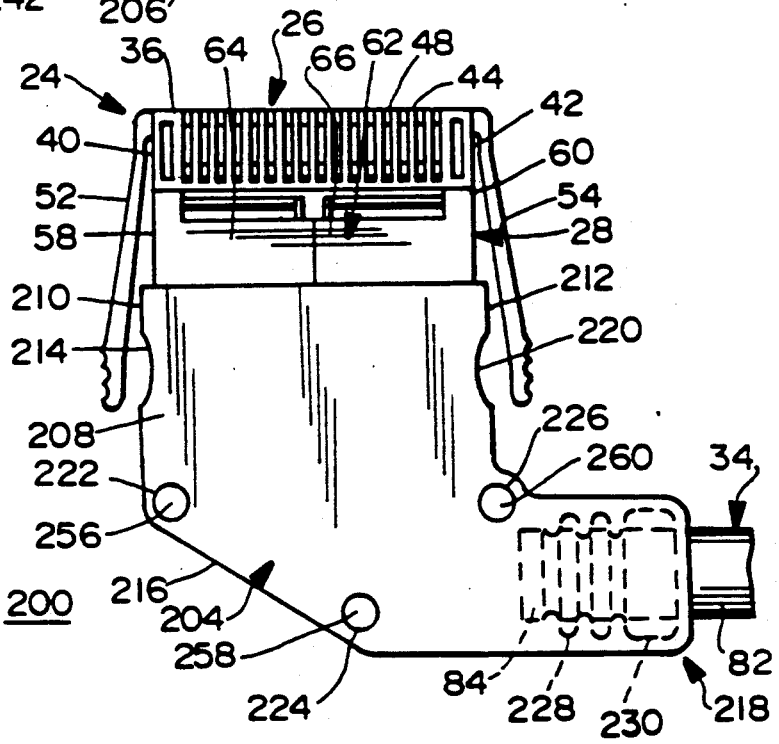
FIG. 5 in a bottom view of an electrical connector assembly also embodying the present invention showing an alternate cable termination configuration (i.e., a right angle termination) provided by a conductive shell clamped onto a shielded electrical connector.

Referring now to FIGS. 5–7, therein is disclosed the electrical connector assembly 200 that also embodies the present invention. The various elements or components of the electrical connector assembly 200 that are identical with a corresponding element or component of the electrical connector assembly 20 disclosed in FIGS. 1–3 are designated by the same reference numerals as those elements or components are referred to with respect to the electrical connector assembly 20. The electrical connector assembly 200 actually includes the identical shielded electrical connector 22 with conductors 50 extending out from the rear wire receiving end 46 that are adapted to be coupled to the conductors 32 in the cable 34 in the same matter as described above with reference to FIGS. 3–4 of the drawings. The difference between the electrical connector assembly 20 and the electrical connector assembly 200 is in the shape of the shells that are clamped onto the electrical connector 22, the shell 30 in the case of the electrical connector assembly 20 and a shell 202 in the case of the electrical connector assembly 200.

More specifically, the shell 202 is adapted to maintain the cable 34 with respect to the electrical connector 22 such that the cable 34 extends to the electrical connector 22 generally at a right angle or perpendicularly to the axis that extends between the front mating end 44 and the rear wire receiving end 46 of the electrical connector 22. Like the shell 30, the shell 202 is formed by the mating of two portions or sections, namely a lower or bottom shell portion 204 and an upper or top shell portion 206.

The bottom shell portion 204 has a bottom wall 208 from which extends sidewalls 210 and 212. The sidewall 210 has an indentation 214 and an angled wall portion 216 that extends to a cable clamping rear portion 218. Similarly, the sidewall 212 has an indentation 220. The sidewall 212 is connected directly to the cable clamping rear portion 218. In this manner, the cable clamping rear portion 218 has an longitudinal axis that will be generally at a right angle with respect to the axis of the electrical connector 22 extending between the front mating end 44 and the rear wire receiving end 46 when the shell 202 is secured to the electrical connector 22. A screw hole 222 is located at one end of the angled wall portion 216 and another screw hole 224 is located at the end of the angled wall 216 where it meets with the cable clamping portion 218. A third screw hole 226 is located where the sidewall 212 intersects the cable clamping portion 218. As is seen in FIG. 5, the cable clamping portion 218 has semi-circular fingers 228 that are adapted to grip the braided cable shield 84 when the shell portions 204 and 206 are mated in order to couple the braided shield 84 to the shell 202 and thereby to the shield 28 surrounding a portion of the dielectric housing 24. In addition, the cable clamping portion 218 includes a semi-circular finger 230 that grips the outer insulation 82 on the cable 34 when the shell portions 204 and 206 are mated to provide a portion of a cable strain relief for the cable 34.

The upper shell portion 206 generally has the same overall configuration as the bottom shell portion 204 and includes a top wall 232 from which extends sidewalls 234 and 236. The sidewall 234 has an indentation 238 and an angled wall portion 240 that extends to a cable clamping rear portion 242 at the rear of the shell portion 206. Similarly, the sidewall 236 has an indentation 244. The sidewall 236 is connected directly to the cable clamping rear portion 242. A screw hole 246 is located at one end of the angled wall portion 240 and another screw hole 248 is located at the end of the angled wall 240 where it meets with the cable clamping portion 242. A third screw hole 250 is located where the sidewall 236 intersects the cable clamping portion 242. As is seen in FIG. 7, the cable clamping portion 242 has semi-circular fingers 252 that are adapted to grip the braided cable shield 84 when the shell portions 204 and 206 are secured together in order to assist in coupling the braided shield 84 to the shell 202 and thereby to the shield 28 surrounding a portion of the dielectric housing 24. In addition, the cable clamping portion 242 includes a semi-circular finger 254 that grips the outer insulation 82 on the cable 34 when the shell portions 204 and 206 are secured together to provide a portion of the cable strain relief for the cable 34.

The two portions 204 and 206 of the shell 202 are adapted to be mated together so as to form the shell 202 about the electrical connector 22 as shown in FIGS. 5–7. The two portions 204 and 206 are held together with screws 256, 258 and 260 that extend through the holes 222, 224 and 226, respectively, in the bottom portion 204 and that become engaged in the threaded holes 246, 248 and 250 in the top portion 206. As a result, the sidewalls 210 and 212 of the bottom shell portion 204 mate respectively with the sidewalls 234 and 236 of the top shell portion 206. When so positioned about the electrical connector 22, the sidewalls 210 and 212 of the bottom shell portion 204 engage the sidewalls 40 and 42 of the shield 28 adjacent the indentations 214 and 220, respectively. Similarly, the sidewalls 234 and 236 of the top shell portion 206 engage the sidewalls 40 and 42 of the shield 28 adjacent the indentations 238 and 244, respectively. The shell 202 thereby is coupled to the shield 28.

When mated together, the shell portions 204 and 206 also form a pocket 262 between the sidewalls 210 and 212 and sidewalls 234 and 236. The pocket 262 provides an enclosed and shielded area for the disposition of the splices between the conductors 32 in the cable 34 and the conductors 50 extending out from the rear wire receiving end 46 of the electrical connector 22.

The cable clamping portions 218 and 242 of the shell portions 204 and 206 also are mated together and couple the shell 202 to the braided shield 84 of the cable 34. This is accomplished through the fingers 228 in the case of the bottom portion 204 and the fingers 252 in the case of the top portion 206 gripping the braided shield 84 when the shell 202 is installed on the electrical connector 22. Moreover, the cable clamping portions 218 and 242 through the finger 230 in the case of the bottom shell portion 204 provides a cable strain relief mechanism for the cable 34 after the shell 202 has been positioned on the electrical connector 22.

With the shell 202 enclosing at least a portion of the electrical connector 22 and encompassing the connections between the conductors 32 in the cable 34 and the conductors 50 extending into the electrical connector 22 and with the shell 202 being connected to both the shield 28 and the grounded braided shield 84 of the cable 34, the shell 202 provides an EMI/RFI shield for a portion of the electrical connector 22 and the wire connections. Moreover, the die-casted shell 202, in clamping onto a standard shielded electrical connector, such as the electrical connector 22, can provide a right angle termination for the cable 34 as it extends to such an electrical connector 22 without requiring special tooling for a stamped and formed shield for such a termination between the cable 34 and the electrical connector 22.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. An electrical connector assembly for use with a cable having a plurality of cable conductors enclosed in a cable shield and a cable insulation, said electrical connector assembly including an electrical connector having a dielectric housing with sidewalls extending between a mating end and a wire receiving end, contacts within said dielectric housing, each said contact having a mating portion adjacent said mating end and a wire receiving portion, connector conductors extending out from said wire receiving end of said connector, each of said connector conductors being coupled to one of said contacts, a conductive connector shield surrounding said dielectric housing and starting from a position on the housing remote from the mating end and contiguously extending in a lateral direction to completely surround the housing ending in a position remote from the wire receiving end, said electrical connector assembly further including a conductive clamp-on shell comprising:

first and second mating shell portions adapted to be mated together, said mated first and second shell portion having a clamp-on portion for overlaying and detachably clamping onto said conductive connector shield, said shell portions enclosing said wire receiving end of the connector housing, a pocket portion for enclosing connections made between said cable conductors and said connector conductors and a cable clamping portion for gripping said cable shield and said cable insulation.

2. The electrical connector assembly as set forth in claim 1 wherein said conductive connector shield is stamped and formed and wherein said first and second mating shell portions are die-cast.

3. The electrical connector assembly as set forth in claim 1 wherein said conductive connector shield is stamped and formed and wherein said first and second mating shell portions are molded from conductive plastic.

4. The electrical connector assembly as set forth in claim 1 wherein said conductive connector shield is stamped and formed and wherein said first and second mating shell portions are molded from non-conductive plastic and coated with a conductive material.

5. The electrical connector assembly as set forth in claim 1 wherein said pocket portion is formed by converging wall portions of said first and second mating shell portions that extend from the clamp-on portion to said cable clamping portion.

6. The electrical connector assembly as set forth in claim 1 wherein said cable clamping portion of said first and second mated shell portions has first finger means to grip said cable shield and second finger means to grip said cable insulation when said first and second mating shell portions are mated together.

7. The electrical connector assembly as set forth in claim 1 wherein each of said cable conductors in said cable includes a cable conductor wire enclosed in an inner insulating jacket which is enclosed in a cable conductor shield, which is enclosed in an outer cable conductor insulation jacket and wherein each of said connector conductors extending from said electrical connector includes a connector conductor wire enclosed in a connector conductor insulation and wherein the cable conductor shield of each cable conductor is coupled to a different one of the connector conductor wires and the cable conductor wire is coupled to a different one of the connector conductor wires.

8. The electrical connector assembly as set forth in claim 7 wherein said connections between said cable conductor shield and said one of said connector conductor wires and between said cable conductor wire and said another of said connector conductor wires are enclosed by a heat shrinkable tube that is disposed about said connections.

9. The electrical connector assembly as set forth in claim 7 wherein said connections between said cable conductor shield and said one of said connector conductor wires and between said cable conductor wire and said another of said connector conductor wires are located within said pocket portion of said mated first and second shell portions so that said shell forms a shield about said connections.

10. The electrical connector assembly as set forth in claim 1 wherein said cable clamping portion is disposed at an angle with respect the axis of the electrical connector extending from said mating end to said wire receiving end so that said cable is disposed at an angle with respect to said connector axis.

11. The electrical connector assembly as set forth in claim 10 wherein said angle is generally a right angle.

12. An electrical connector assembly for use with a cable having a plurality of cable conductors enclosed in a cable shield and a cable insulation, said electrical connector assembly including an electrical connector having a dielectric housing with sidewalls extending between a mating end and a wire receiving end, contacts within said dielectric housing, each said contact having a mating portion adjacent said mating end and a wire receiving portion, connector conductors extending out from said wire receiving end of said connector, each of said connector conductors being coupled to one of said contacts, a conductive connector shield surrounding said dielectric housing and starting from a position on the housing remote from the mating end and contiguously extending in a lateral direction to completely surround the housing ending in a position remote from the wire receiving end, said electrical connector assembly further including a conductive clamp-on shell comprising:

first shell portion having a first base wall from which extends first sidewalls forming a first clamp-on portion, a first pocket portion and a first cable clamping portion;

second shell portion having a second base wall from which extends second sidewalls said second base wall and said second sidewalls forming a clamping second-on portion, a second pocket portion and a second cable clamping portion; and fastener means for securing said first and second shell portions together and to said electrical connector such that said first and second clamp-on portions are clamped onto said conductive connector shield, said shell portions enclosing said wire receiving end, said first and second pocket portions enclosing connections made between said plurality of cable conductors and said connector conductors, and said first and second cable clamping portions clamping onto said cable and cable shield, respectively.

13. The electrical connector assembly as set forth in claim 12 wherein said conductive connector shield is stamped and formed and wherein said first and second shell portions are die-cast.

14. The electrical connector assembly as set forth in claim 12 wherein said conductive connector shield is stamped and formed and wherein said first and second shell portions are molded from conductive plastic.

15. The electrical connector assembly as set forth in claim 12 wherein said conductive connector shield is stamped and formed and wherein said first and second shell portions are molded from non-conductive plastic and coated with a conductive material.

* * * * *